US006970099B2

(12) United States Patent
Koro

(10) Patent No.: US 6,970,099 B2
(45) Date of Patent: Nov. 29, 2005

(54) APPARATUS, SYSTEM, AND METHOD FOR DETECTING AND REIMPRESSING ELECTRICAL CHARGE DISTURBANCES ON A DRILL-PIPE

(75) Inventor: Victor Koro, Alberta (CA)

(73) Assignee: Ryan Energy Technologies Inc., Calgary (CA)

( * ) Notice: Subject to any disclaimer, the term of this patent is extended or adjusted under 35 U.S.C. 154(b) by 626 days.

(21) Appl. No.: 10/000,523

(22) Filed: Dec. 4, 2001

(65) Prior Publication Data

US 2003/0102980 A1 Jun. 5, 2003

(51) Int. Cl.[7] ..... G01V 1/28

(52) U.S. Cl. ..... 340/853.7; 340/854.4; 340/870.31

(58) Field of Search ..... 340/853.7, 854.4, 340/854.9, 870.31, 853.2

(56) References Cited

U.S. PATENT DOCUMENTS

| | | | |
|---|---|---|---|
| 1,927,664 A | 9/1933 | Karcher | |
| 2,354,887 A | 8/1944 | Silverman et al. | |
| 2,364,957 A | 12/1944 | Douglas | |
| 2,388,141 A | 10/1945 | Harrington | |
| 2,411,696 A | 11/1946 | Silverman et al. | |
| 2,452,515 A | 10/1948 | Athy | |
| 2,507,351 A | 5/1950 | Scherbatskoy | |
| 2,524,031 A | 10/1950 | Arps | |
| 2,544,569 A | 3/1951 | Silverman | |
| 2,568,441 A | 9/1951 | Fyler | |
| 2,658,725 A | 11/1953 | Arps | |
| 2,677,790 A | 5/1954 | Arps | |
| 2,755,431 A | 7/1956 | Scherbatskoy | |
| 2,759,143 A | 8/1956 | Arps | |
| 2,925,251 A | 2/1960 | Arps | |
| 2,938,708 A | 5/1960 | Arps | |
| 3,015,801 A | 1/1962 | Kalbfell | |
| 3,046,474 A | 7/1962 | Arps | |
| 4,087,781 A | 5/1978 | Grossi et al. | |
| 4,468,665 A | 8/1984 | Thawley et al. | |
| 5,394,141 A | 2/1995 | Soulier | |
| 5,942,990 A | 8/1999 | Smith et al. | |
| 6,075,461 A * | 6/2000 | Smith | 340/853.7 |
| 6,188,223 B1 | 2/2001 | Van Steenwyk et al. | |
| 6,218,959 B1 * | 4/2001 | Smith | 340/853.7 |

OTHER PUBLICATIONS

Title: E.M. MWD Data Transmission Status and Perspectives Authors: Louis Soulier and Michel Lemaitre Date: 1993.

* cited by examiner

*Primary Examiner*—Michael Horabik
*Assistant Examiner*—Hung Dang
(74) *Attorney, Agent, or Firm*—Gowling Lafleur Henders; D. Doak Horne

(57) ABSTRACT

A signal repeater, a system utilizing one or more signal repeaters, and a method for detecting a transient disturbance in the surface charge on drill pipe, which system, apparatus and method are collectively used to transfer data from deep-well and high-conductivity formation subterranean environments to a point nearer to the surface. The signal repeater comprises a housing that is securably mountable to the interior of a pipe-string disposed in a wellbore, which repeater receives and stores electrical signals for resending at an appropriate time.

7 Claims, 3 Drawing Sheets

APPARATUS, SYSTEM, AND METHOD FOR DETECTING AND REIMPRESSING ELECTRICAL CHARGE DISTURBANCES ON A DRILL-PIPE

FIELD OF THE INVENTION

The present invention relates to an apparatus, system, and method for the transfer of information from locations deep under the surface of the earth to locations nearer to the surface of the earth, and vice versa, and more particularly to a system, method, and a signal repeater device for transmitting signals along a drill pipe.

BACKGROUND OF THE INVENTION

Since the 1930's when U.S. Pat. No. 1,927,664 was issued to Karcher, problems, described in the prior art, were associated with both the "mud pulse" fluid and the acoustic means of transferring information. These problems have, to a substantial extent, been solved most in most shallow well applications by using higher reliability electromagnetic ("EM") means by which electrical energy radiates through the surrounding soil formation up to the surface. However, as wells become deeper and also when the formation being drilled through becomes more conductive, the traditional EM means will eventually no longer be effective in radiating sufficiently to reach the surface if relying on passage through the formation—because the EM energy dissipates in the formation to a level below the detection threshold at the surface. Although all EM means traditionally involve an uphole transmitter to radiate into the formation near the surface, the EM solutions to the "deep well" and high conductivity formation problems may be grouped into three (3) quite different categories of teaching:

1) Insulated cable extensions between downhole equipment and uphole transmitter;

2) Multiple Radiating Gaps (MRG) one originating, all transmitting; and

3) Externally Mounted Repeating Transmitters (ExMRTx)

The insulated cable approach has two primary disadvantages:

a) uses an expensive and fragile conducting cable; and b) requires significant time to install, recover, and periodically replace The MRG approach has two primary disadvantages:

a) high power consumption (short battery life) passing sufficient current across the gaps in order to radiate sufficient energy from those gaps; and b) sensitivity to the composition of the formation between the borehole and the surface sensing point (electrode).

And, the ExMRTx suffer four primary disadvantages:

a) high power consumption (short battery life) passing sufficient current across the gaps in order to radiate sufficient energy from those gaps; and b) sensitivity to the composition of the geologic formation between the borehole and the surface sensing point (electrode);

c) high noise sensitivity demanding more complex electronics and signal processing; and d) inability to deploy in exploration mode (i.e. only applies to "operational" wells).

Therefore, a need has arisen for an economical system that is capable of more effectively using the traditional component spaces available in a drill-string. The objects of the present invention include:

a) eliminate fragile conducting cables;

b) lower power consumption to extend battery life;

c) desensitize method to formation composition "away from" the borehole;

d) desensitize apparatus to noise permitting the use of more robust, simpler electronics and signal processing; and e) simplify installation in any well functional (exploration or operational) mode.

The fundamental energy transport mechanisms for heat, mass, and momentum (all forms of energy) are: conduction, convection, and radiation, all 3 of which mechanisms are always involved in the actual transfer of energy—however, different mechanisms dominate in different environments. In the deep-well downhole environment both convection and radiation have limited influence, as they would in a submarine environment. In fact in studies conducted by the US Navy using extremely low frequency ("ELF")—conventional "radio" techniques based on electro-magnetic radiation have been determined to be impractical in electrically conductive sea water. This is significant because the prior art reviewed fails to address the electrical characteristics of drilling mud, which has some similarity to sea water. Moist soil will also bear some similarity to sea water, such that the combination of drilling mud and moist soil as a communication medium for downhole data transfer suggests the ELF range analysis will be a useful contribution to the cumulative wisdom of electric field telemetry (EFT) in this industry.

The US Navy has also determined that generating a "useful signal" using the traditional radiating antenna model of EM communications requires an unusually long physical antenna because the antenna length is inversely proportional to the frequency. By example, to achieve any "reasonable efficiency" at a frequency of 76 Hz, the Navy constructed two antennas each made up of two or three parallel power lines—each line being at least 14 miles long. Since most EFT prior art patents teach operation in the 2–10 Hz range, the above suggests that describing the average drill-string or any of its components as an "antenna" is likely not appropriate and possibly misleading. The inventor does not accept the descriptions provided in the prior art despite having to use those descriptions in reviewing what said art teaches.

Electric current is conventionally defined as the rate of flow of positive charge despite the fact that when using metal conductors (including drill-pipe segments), the mobile charge element is actually the negatively charged electron. As electrons move from one location on a metal surface to another location, they leave behind a transient void of negative charge that appears as a brief but relatively positive state. Due to the high mobility of electrons on a metal surface the void is quickly filled by electrons from an adjacent region of the drill-pipe surface, which process repeats indefinitely until the metal surface equilibrium state is restored from an external source (possibly mobile charge in the drilling mud) or is disturbed otherwise. In a drilling environment the path of least resistance is going to be the metal drill-pipe along which such disturbances will ripple, with each disturbance forming a wave-front. If drill-pipe were made of a material (e.g. ceramic) that does not support highly mobile surface charge, then the present invention would not function—even though the prior art based on insulating gaps (with a conductive material acting as an electrode at each end) would still "radiate" into the formation.

Notwithstanding that all electric "fields" in theory extend to infinity in 3 dimensions, the practical presence of a field depends upon the measurable effect it can have on relevant charged bodies in its vicinity. It is common knowledge that an accelerating charge "radiates" energy in the form of an electromagnetic field that propagates outward disturbing all (electric, magnetic, and electro-magnetic) fields (both static and dynamic) present in the space through which it passes. When the same charge reaches a steady state (whether stationary or moving with constant velocity) it ceases to "radiate". Consequently, in the ELF range, the relatively low acceleration of (long wavelength) charge in the current flowing across insulating gaps results in low levels of radiation. Instead, as the charge configuration creating the baseline electric field around the surface electrode is disturbed by this influence propagating through the formation (via displacement effect) each time a "pulse" crosses a gap—a temporally retarded potential difference is transiently generated in that space—creating a disturbance in the baseline or equilibrium potential difference in the earth between the blowout preventer and the surface sensing electrode. This is the potential difference the disturbance of which is detected by the prior art (e.g. U.S. Pat. No. 4,468,665, discussed below), and which, because it does not depend on the pipe surface relaxing, has the greater potential bandwidth required in only some applications. This field disturbance will be superimposed on the fields resulting from the surface charge mobility, but the influence that it has on those fields will depend on the formation composition. The above described "electrical" effect is similar in all of the EFT prior art patents reviewed.

The conventional deep-well EM data transfer system, such as that disclosed in U.S. Pat. Nos. 6,188,223 and 5,883,516, FIG. 2*b* thereof, discussed below, consists of:

a) a drill head sensor and encoding (typically using a Binary Phase Shift Key "BPSK" scheme) electronics package;

b) a downhole power source (typically a lithium ion battery)

c) a downhole amplifier and coupling means to transfer current across a downhole insulating gap into the formation;

d) a lengthy and expensive insulated conductor.

In order to overcome the disadvantages of the above prior art approach in an efficient manner it was necessary to first do two things:

1) understand the electro-physical principles involved in surface detectable EM measurements; and 2) understand what information needs to be transferred uphole in the majority of the applications of EFT.

An information-carrying energy flow may be efficiently channelled along a drill-string, despite any radiation into the formation as a secondary effect incidental to feedback across the insulating gaps that prevent a direct short between the source terminals. Such information carrying flow is akin to a wave-front guided by a power transmission line. With the said flow following a narrow cylindrical channel along the drill-string, the composition of the formation (surrounding the borehole horizontally, and between the drill head and the surface electrode vertically) is no longer relevant for information transfer purposes. Only in the shallow surface layer between an optional uphole transmitter and its surface electrode could the electrical characteristics of the formation have any influence over the transfer of information. In fact, deep layers of highly conductive material in the formation would tend to insulate the surface antenna/electrode from any noise generated by drill-string gaps deeper in the formation.

Analysis of the above could be conducted (according to Jordan and Balmain, LCCCN 68-16319) by considering a chain of "Hertzian dipoles" each having a slightly different amplitude such that "the adjacent charges do not completely cancel, and there is an accumulation of charge on the surface" of the conductor. This iterative analysis places an understanding of the circuit involved in a conductive drill-string within the reach of simple circuit concepts (based on Ohm's Law) that are cumulatively compatible with the displacement effect described below. The chain of dipoles model is also consistent with a cylindrical "antenna" that is broken down into a series of short segments each being a separate circuit that results in an incremental loss feeding into the next segment (circuit). However, the non-uniform transmission line model guiding spherical wave fronts is a more effective means of understanding the manner in which a drill-string can be useful transferring data. Realizing that a drill-pipe is a hollow, large diameter, conductive tube with a finite wall thickness, is the starting point for understanding that capacitance can exist between points on a continuous conductive surface, which is only one departure from the relatively thin, solid core, perfect conductor assumed in the prior art traditional analysis. Also, recognizing that a normal length drill-string would not radiate per se in the relevant frequency range, it is clear that the prior art must in fact be using the drill-pipe segments as electrodes, the current flow between which segments generates magnetic fields normal to the direction of that current flow. Therefore, as set out above, it is via a displacement mechanism that the magnetic field influence then propagates through the formation to influence the electric field at the surface, causing a detectable disturbance in the potential difference between the blowout preventer and an electrode driven into the ground nearby. Even in deep well environments, prior art such as U.S. Pat. No. 6,075,461 to Halliburton Energy Services Inc continues to teach the use of such EM disturbances that propagate through the formation triggering a series of repeaters mounted external to the drill-pipe.

The prior art does not directly address the "efficiency" of the so-called antenna or even the efficiency of the impedance matching between the pipe and the formation, but it does indirectly recognize the importance of this factor when it teaches the need to "drive" sufficient current into the formation by ensuring that the resistance of the electrical path through the gap material is substantially higher resistance than the formation path. Since all EFT systems use a form of sensitive galvanometer at the surface to detect (as a change in electrical potential at the formation surface) the influence of a source of moving electrical charge deep below the surface —it is clear that whatever propagates must have the capacity to disturb an electric field to a detectable extent.

Typical formations have dielectric characteristics, containing charged particles that have limited mobility. At the surface the charge in the formation will have reached a relatively stable state of equilibrium (as will the charge distributed throughout the inhomogeneous formation between the surface and the downhole source) that will experience a force via a displacement effect that transiently disturbs the equilibrium state each time charge pulses across the downhole gap. Starting from the basic premise that the further the point of detection (i.e. the pair of surface electrodes) is from the source (i.e. the gap) of the information carrying EM disturbance, the more charge must flow across that source gap to generate a specified level of detectable change in the static electric and magnetic fields at that point of detection. In any given formation, the higher the (charge flow per unit time) current, the stronger the field strength, and the deeper the well from which it can be detected, but the shorter the battery life. In a design that channels the displacement effect directly up the (highly conductive) metal drill-pipe, the attenuation takes place over a greater distance permitting detection over a longer range, requiring fewer repeaters and shorter bursts, also resulting in lower power consumption.

The prior art reviewed herein includes:

U.S. Pat. No. 6,188,223—Feb. 13, 2001 to Scientific Drilling International ('223)

U.S. Pat. No. 6,075,461—Jun. 13, 2000 to Halliburton Energy Services Inc ('461)

U.S. Pat. No. 5,942,990—Aug. 24, 1999 to Halliburton Energy Services Inc ('990)

U.S. Pat. No. 5,394,141—Feb. 28, 1995 to Geoservices ('141)

U.S. Pat. No. 4,468,665—Aug. 28, 1984 to Tele-Drill, Inc. ('665)

U.S. Pat. No. 4,087,781—May 2, 1978 to Raytheon Company ('781)

None of the EFT prior art recognizes the electrode nature of the drill-pipe or offers a rigorous scientific analysis of the influence of the ionic solution (drilling mud) inside as well as surrounding the pipe and filling the annulus external to it. Clearly a moving ionic solution creates EM effects of its own, but its net influence on the EM fields resulting from the current flowing across the "gap" in the drill-string is left undefined and is therefore an opportunity to improve the teachings of the prior art in this field of invention.

Specifically, US '461 to a "Disposable Electromagnetic Signal Repeater" discloses an apparatus, system, and method for communicating real time information between surface equipment and downhole equipment using electromagnetic waves to carry the information. An electromagnetic signal repeater 34,36 is disclosed that may be securely mounted to the exterior of a pipe string 30 disposed in a well bore. A transmitter 44 generates electromagnetic waves that are picked up by a receiver of repeater 34, such repeater 34 mounted by straps on the exterior of the pipe string uphole from the transmitter 44. Repeater 34 is spaced along drill string 30 and above transmitter 44 to receive electromagnetic waves 46 while such waves 46 remain strong enough to be detected. The pipe string does not have any insulating (non-conductive) gaps. To prevent a direct electrical short circuit occurring between repeater 34 and tubing string 30 that would inhibit the propagation of electromagnetic waves 46, an insulating layer 108 is provided in the repeater 34,36. When repeater 34 re-transmits the electromagnetic waves that it has received, current flows through the lower part of the repeater 34 (housing subassembly 106) which is in electrical contact with pipe string 30, which current flow generates axial current in the pipe string 30 to produce electromagnetic waves 46 that propagate through the formation to an uphole repeater 48, which is capable of repeating the foregoing sequence.

Disadvantageously, to cause an axial current in the pipe string 30, electromagnetic signal repeaters 34,36 such as the type disclosed in US '461 (although not expressly so mentioned in US '461) typically utilize electromagnetic coils, which coils make repeaters 34,36 large, bulky, relatively expensive, and relatively high in power consumption (shortening their battery life). Further, due to such repeaters being mounted on the exterior of a pipe string, they are only suited to operational wells and not for MWD ("measurement while drilling").

US '781 entitled "Electromagnetic Lithosphere Telemetry System" teaches repeater stations 144 spaced at predetermined intervals along the drilling pipe, and are contained in repeater sections 126 which form an integral part of drilling pipe assembly 125. Disadvantageously, solenoidal antenna 146 (ref. FIG. 3 thereof) comprised of high permeability core rods wrapped in wire coils, which in the preferred embodiment comprise a rod approximately 1 inch thick, 2 inches in width, and 20 feet in length, coupled at each end to a transceiver in the repeater station are required in order to transmit and receive the signals. The signals are transmitted via such antennae 146 through the formation (i.e. through the earth's lithosphere) to the next repeater station. Pipe strings without any insulating gaps are used.

US '223 entitled "Electric Field Borehole Telemetry" teaches the use of wave forms selected for "optimum transmission characteristics in the underground formation". Further, FIG. 1*b* illustrates an assembly in which each battery and circuitry assembly has a single connection on each side of each gap. These two factors confirm that the information transmission path is through the formation, and not via the pipe string since the objective of each gap is merely to impose a barrier around which the current will prefer to pass through the "formation" for which US 223 teaches impedance has been optimized. Disadvantageously, the means of transmission requires an electrically conductive cable 6 extend down the center of the pipe string. This cable 6 breaks frequently during installation, use, and removal.

US '990 entitled "Electromagnetic Signal Repeater and Method for use of Same", teaches an apparatus and method based on an interiorly mountable repeater, suited to MWD applications Insofar as could arguably be said to relate to the inventions later set out herein, US '990 teaches at col. 9 & 10, and FIGS. 4A&B, an electromagnetic signal repeater 330, having an isolation subassembly 348 which provides a discontinuity in the electrical connection between lower connector 352 and upper subassembly 346 of the repeater 330 thus providing a discontinuity in the electrical connection between the portion of drill string 30 below repeater 330 and the portion of drill string 30 above repeater 330. In operation, a receiver 374 is provided to receive an electromagnetic input signal (delivered via the earth and not the drill pipe since such signal propagates through the formation—see below) carrying information that is transformed into an electrical signal that is passed onto electronics package 376 (sic-not identified) via electrical conductor 378. Electronics package 322 (sic-378?) processes and amplifies the electrical signal. An output voltage is then applied between intermediate housing member 342 and lower mandrel section 358, which is electrically isolated from intermediate housing member 342 and electrically connected to lower connector 352, via terminal 380 on intermediate housing member 342 and terminal 382 on lower mandrel section 358. The voltage applied between intermediate housing member 342 and lower connector 352 generates a current flow through the geologic formation proximate the repeater that results in an electromagnetic output signal that is "radiated" into the formation. Unlike the present invention, a significant and patentably distinct difference between US '990 and the present invention, as will later be more fully explained, is that the input signal to the repeater 330, and more particularly to the receiver 374 of US '990, is electromagnetic in nature and is received by the receiver 374 after and via its passage through the earth rather than along the drill pipe. Coil based designs such as that of the receiver of US '990 are very sensitive to noise resulting in the need to use both more expensive electronic components and more sophisticated signal processing in their implementation. Moreover, the signal distortion in schemes such as that of US '990, which amplify and repeat the subject signal, without a "silence time" delay, build in a cumulative error unlike the detection and replacement scheme inherent in a silence time based design.

US '141 entitled "Method and apparatus for transmitting information between equipment at the bottom of a drilling or production operation and the Surface", as the title suggests, relates to methods of transmitting information from downhole equipment. Such patent teaches the use of insulated wires, which are problematic for the reasons given above US '665 teaches a power amplifier used in this environment.

SUMMARY OF THE INVENTION

The disclosed invention solves a number of problems with the prior art by eliminating cables, lowering battery power consumption (to extend battery life), desensitizing data reception to the composition of the formation, desensitizing the signal transferring apparatus to noise thereby permitting the use of simpler electronics and simpler signal processing techniques, and simplifying both installation in and removal from any drilling well whether in exploration or production mode. This invention teaches how a drill-string may be used inexpensively as a low bandwidth transmission line to guide borehole data to the surface. More particularly, the invention teaches a method of using a system employing an apparatus that detects, stores, and resends signals comprising a series of transient disturbances of the electrical surface charge on a drill-pipe from which data may be extracted.

Accordingly, in one of its broadest embodiments, the present invention comprises an apparatus, namely a signal repeater, coupleable to and adapted for use with a drill pipe string, comprising: a source of electrical energy; means for electrically contacting said pipe string for receiving a pre-modulated electrical signal from said pipe string; means for storing said signal in a memory means; means for initiating the re-sending of said signal; and means for impressing said signal on said pipe-string. The system of the present invention is easily decoupled and retrieved from the drill pipe string for reuse. Similarly the within inexpensive and robust electronic circuitry is easily replaced in the housing of the apparatus permitting effectively unlimited reuse of the most expensive components of the system of the present invention.

In a greatly preferred refinement, the signal repeater means of the present invention is adapted for use with a drill pipe-string having therealong at least one insulating gap comprising a substantially electrically non-conductive portion. In addition, in a further preferred embodiment, the means for electrically contacting said pipe string comprises an electrical point of contact along said pipe string on a downhole side of said insulating gap; and the means for impressing said signal onto said surface of said pipe string comprising an electrical point of contact with said pipe string on an uphole side of said insulating gap, and further means for applying said signal across said point of contact on said downhole side and a point of electrical contact to said pipe string on said uphole side of said insulating gap. In yet another preferred embodiment, the signal repeater apparatus of the present invention further comprises a housing, wherein such housing is detachably mountable within the pipe string.

It is generally understood that the signal repeater apparatus of the present invention will be used for receiving information gathered by sensors at the bottom of a well, and resending that information to a receiver nearer to the surface. However, the signal repeater apparatus of the present invention may be used to send in the reverse direction, namely data from the surface to downhole equipment nearer to or at the bottom of the well.

It is contemplated that the signal repeater apparatus of the present invention will be situate interiorly within a pipe string, but not obstruct the flow of drilling mud that may flow through the interior annulus of the drill pipe created by the repeater apparatus when situate within the pipe string. However, the signal repeater of the present invention is not contemplated as being restricted to locations interiorly of a pipe string, and may be situate inside the walls of a pipe string, along or on the exterior of well casings, tube strings, and any other downhole electrically conductive element reaching the surface with which the signal repeater can make contact. Accordingly, the phrase "pipe string" generally means the downhole drill pipe string supplying fluid pressure to the drill motor, but is not limited to such and includes any of the electrically conductive members of downhole pipe and drill string components, including casing members, tube string, drill strings, and the like useable in well drilling.

In another aspect of the invention, the invention comprises a system for communicating information between downhole equipment in a well bore and equipment near the surface, comprising: a pipe string extending downhole into the well bore; a downhole device electrically coupled to said pipe string for impressing a pre-modulated electrical signal onto said pipe string; and a signal repeater means coupled to and adapted for use with said pipe string, said signal repeater means having the configuration as set out above, namely a source of electrical energy, means for electrically contacting the pipe string for receiving a pre-modulated electrical signal from said pipe string; means for storing said signal in a memory means; means for initiating the re-sending of said signal; and means for impressing said signal on said pipe string.

In a preferred embodiment, the system of the present invention utilizes a pipe string having therealong at least one insulating gap comprising a substantially electrically non-conductive portion, wherein the signal repeater means is electrically coupled to said pipe string proximate said insulating gap. In yet a further refinement of the system of the present invention, the means possessed by the signal repeater means of the present invention for electrically contacting said pipe string comprises an electrical point of contact along said pipe string on a downhole side of said insulating gap, and the means for impressing said signal of said repeater means on said pipe string comprises an electrical point of contact with said pipe string on an uphole side of said pipe string, and there is further provided means for applying said signal across said points of electrical contact on said downhole side and said uphole side of said insulating gap so as to thereby impress the signal on a surface of the pipe string for transfer along the pipe string. In a further refinement, the system of the present invention utilizes a signal repeater that includes a housing, and such housing is situate inside the inner circumference of one or more sections of drill pipe forming a pipe string, preferably proximate the insulating gap.

In yet a further aspect of the invention, a method for communicating information between downhole equipment in a well bore and equipment nearer to the surface via a pipe string utilizing a signal repeater means, comprising: receiving information in the form of a pre-modulated electrical signal from a point of electrical contact of said signal repeater means with said pipe string at a position intermediate said downhole equipment in a well bore and said equipment nearer to the surface; storing said signal locally in memory means within said repeater means; initiating the re-sending of said signal; and impressing said signal on said pipe string to enable said signal to pass further along said pipe string.

In an instance where a pipe string having one or more insulating gaps is employed, the above method can be adapted to take advantage of such insulating gaps to interrupt residual charge disturbances that were impressed prior in time, as well as to facilitate resending the signal after the repeater's specified "silence time" delay period. More particularly, in such instance the method of the present invention further comprises situating said signal repeater means proximate said insulating gap, and the step of receiving information from a point of electrical contact with said pipe string comprises electrically contacting said pipe string proximate said electrically non-conductive portion but on a downhole side thereof so as to receive signals from said point of electrical contact with said pipe string, and the step of impressing said signal onto said surface of said pipe comprises applying the signal across said point of electrical contact with said pipe string downhole from said insulating gap and a point of electrical contact with said pipe string uphole from said insulating gap. This latter step of resending the signal by applying it across the insulating gap comprises impressing electrical charge on the surface of a drill-pipe segment in a coded sequence of short time duration electrical contacts a plurality of such impressions being the signal. Of note, where a coded sequence is employed, as in the preferred embodiment, Binary Phase Shift Keying (BPSK) is one scheme that may be employed. Further, the BPSK with Silence Time and Memory, utilized in a preferred embodiment of the present invention does not amplify the signal "received", but merely uses the information that the charge on the pipe surface has experienced a threshold displacement—to build an entirely new unit of data to be sent out after the silence period as a fresh unit of data with properly conditioned impulse time duration and synchronization.

Economically in terms of components, in a preferred refinement, the invented system may use the same point on each associated drill-pipe segment as an electrode for both input and output purposes. As the repeater apparatus switches modes (receiving/sending) the control circuitry changes the function of the uphole drill-pipe electrode contact.

In the preferred embodiment, feedback suppression circuitry operates at the input terminal to each repeater to ensure that the initiating potential impressed on the output-side pipe segment of each repeater does not feed back across the associated gap to stimulate the input terminal of the same repeater. Despite reducing theoretical bandwidth, an interstitial "silence time" coupled with a "long cycle" to permit relaxation of the drill-string and surrounding formation ensures the stable and reliable operation of this design. A simple storage register maintains the units of data that are the signal during the silence time until the relay process resumes.

In one of its broadest embodiments, the invention further comprises a method of using a drill-pipe as a transmission line by adjusting both the silence time between the storage and resending of data, and the data unit duration, to thereby achieve effective operation in varying compositions of both geologic formation and the ionic solution surrounding a drill-string, comprising the steps of: measuring the electrical parameters of the drilling mud; processing an equation formulating the rate of ambient charge dissipation; referencing a lookup table defining the drill-string relaxation time; and altering the electronics package reference to a different associated ROM supplying the parameters controlling silence time and data unit duration.

According to the invention, in one of its broad embodiments, there is provided herein an apparatus combined with a method for using specified components of the traditional drill-string in a novel manner. The improvements over the prior art consisting of shorter duration pulses of varying frequency that trigger repeaters in sequence, with each repeater detecting threshold changes in electrical potential (i.e. disturbances in the electrical charge distribution) on the surface of the drill-pipe, unlike the prior art which is triggered by EM fields that unavoidably propagate into the formation. Due to feedback effects and drill-pipe surface relaxation delays, the present invention has a narrower bandwidth than the prior art. However, the present invention: uses no cables, requires less battery power, requires fewer repeaters, is not sensitive to the electro-physical composition of the surrounding formation, is durable, and easy to install, such that it requires less time to setup and fewer maintenance sessions. In essence, the inventor uses the traditional drill-pipe segments each as an ELF transmission line, not as an electrode. While each insulating gap in the drill-string still "radiates" or creates a normal magnetic field, the present method does not depend on "driving" sufficient current into the formation to propagate the information carrying disturbance to the surface. Instead, transient changes in the surface potential of the pipe segment communicate with the input terminal of a sensitive detector that is part of the repeater assembly. Despite a narrower bandwidth than the prior art, the present invention has sufficient bandwidth for the common D&I (Direction & Inclination) data of its primary operation—while being less expensive and more reliable.

In another aspect of the invention, the invention comprises a method for communicating information between downhole equipment in a well bore and equipment nearer to the surface via a pipe string utilizing a signal repeater means, comprising: receiving information in the form of a pre-modulated electrical signal from a point of electrical contact of said signal repeater means with said pipe string at a position intermediate said downhole equipment in a well bore and said equipment nearer to the surface; storing said signal locally in memory means within said repeater means; initiating the re-sending of said signal; and impressing said signal on a surface of said pipe string to enable said signal to pass further along said pipe string.

According to the invented method, localized charge on the surface of the drill-pipe is transiently disturbed by an ELF wave front (following the drill-pipe akin to a transmission line) such that the charge concentration (density) at the input terminal to a detector measuring simple potential difference will rise sufficiently to be identified and initiate a record in the repeater's memory for later output—although the BPSK scheme is used in one of the preferred embodiments, it represents only one example of the protocols suited to this task.

According to the invented method, an infinite number of "short circuits" arise through the annular flows of electrically conductive drilling mud to the ground terminal of the prior/lower source (whether a downhole sending unit or a repeater). As the uphole drill-pipe segment rises temporarily to the specified terminal potential, charge will bleed off the pipe surface through an infinite number of parallel paths around and along that surface (a cylindrical electrode) to the grounding terminal of the prior/lower source. Consequently to better understand the invention it may be considered in terms of a "floating ground" in which the ground potential varies over both time and space such that the information is carried only in the presence or absence of a disturbance rather than in the amplitude of the potential difference between the drill-pipe surface at the point of detection and the ground return path through the moving fluid.

According to the invented method, even though the electrical potential gradient established along the surface of the uphole drill-pipe segment may exist for only a relatively short linear distance when subject to a static (DC) input signal, an ELF time varying input generates a wavefront that follows the drill-pipe segment vertically—disturbing the charge distribution at the pipe surface to ionic solution interface to at least the point where the next repeater's input terminal contacts the uphole pipe segment. In simple terms, the region of the drill-pipe around the next uphole input terminal behaves like a capacitor in the sense that—as the ELF wavefront passes through that region the displaced charge is detectable as a transient change in the local equilibrium electrical potential. In the ELF range the application of a transmission line analysis is more practical than the more strictly correct analysis that would result from an application of Maxwell's equations. Unlike an output antenna that "radiates" with energy "detaching" and propagating through free space, the drill-pipe segments simply guide or channel energy in a sub-radiation mode that directs a wavefront with a toroidal leading edge to transfer energy via the annulus external to the pipe.

BRIEF DESCRIPTION OF THE DRAWINGS

The present invention, in order to be easily understood and practised, is set out in the following non-limiting examples shown in the accompanying drawings, in which.

DETAILED DESCRIPTION OF THE PREFERRED EMBODIMENT

Figure 1:
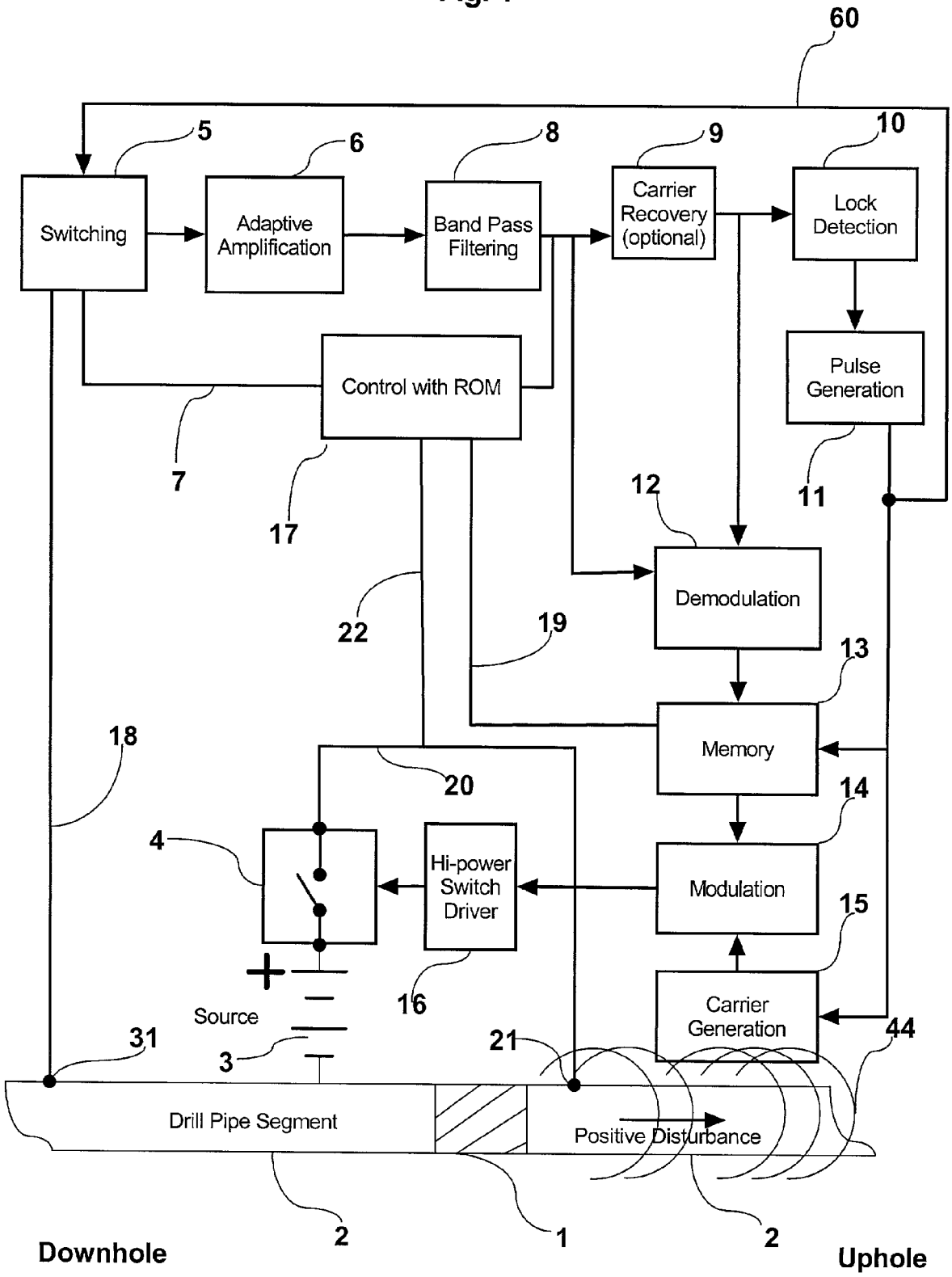
FIG. 1 is a schematic diagram of the ECD signal repeater apparatus of the present invention, adapted for use with a drill pipe string having therealong at least one insulating gap comprising an electrically non-conductive portion.
Figure 2:
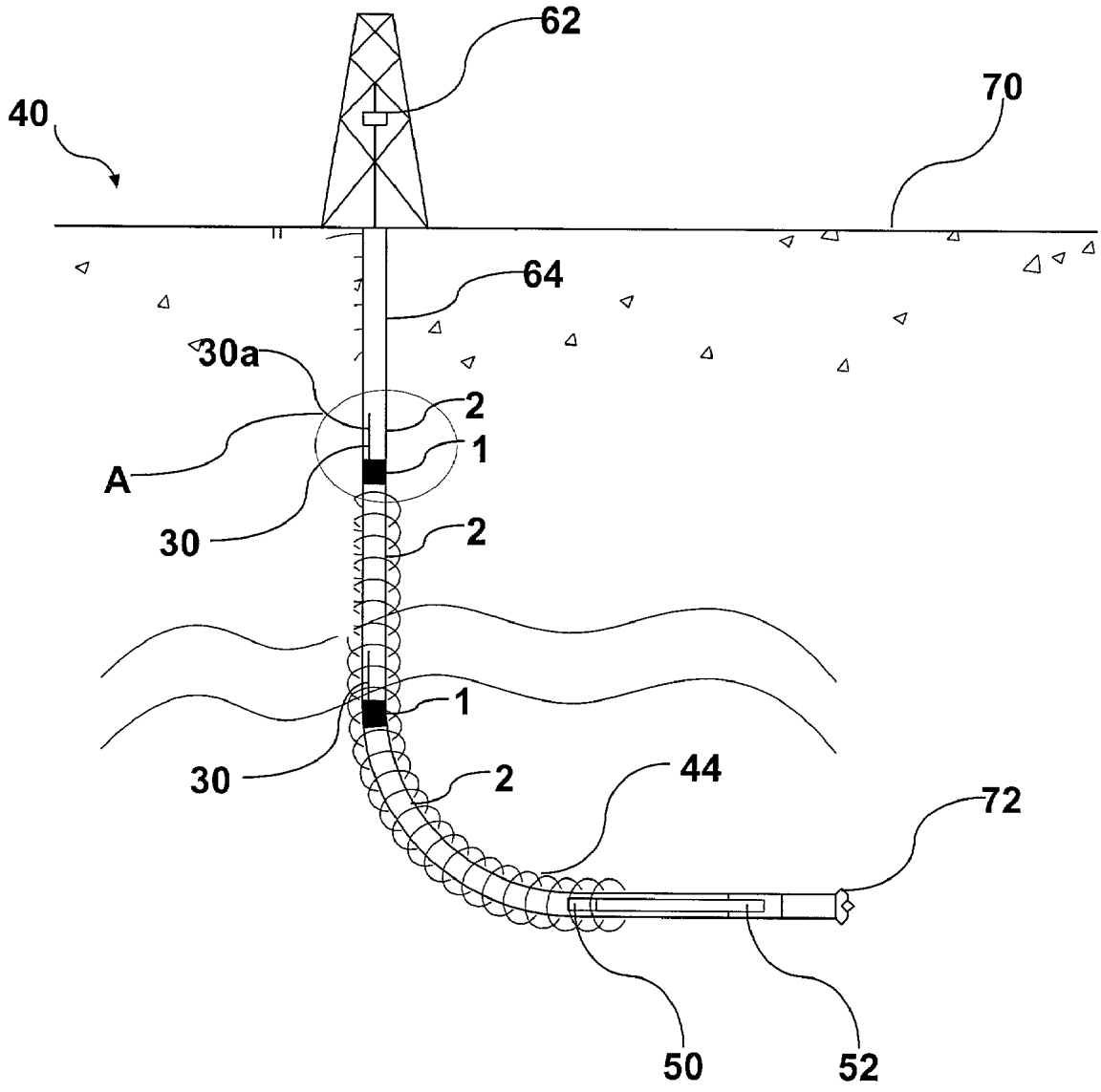
FIG. 2 is a side elevation of a drill-string system in which the invented apparatus may be installed and the method practised, adapted for use with a drill pipe string having a plurality of insulating gaps.

Reference is to be had to FIGS. 1 & 2, wherein like items are identically numbered.

FIG. 2 shows a system 40 of the present invention, wherein a signal repeater 30 of the present invention is employed in order to receive a pre-modulated electrical signal 44 at insulating gap 1 in drill pipe string 2 that extends below the earth's surface 70. Signal 44 is generated by an off-the-shelf Downhole Sending Unit ("DSU") 50, which itself comprises a Code Sequence Generator ("CSG") (not shown) and a power source, typically a battery (not shown). DSU 50 generates signal 44 using data supplied to it by an off-the-shelf instrumentation package, such as a direction and inclination sensing device (i.e. a "D & I" unit) 52 commonly employed, in downhole drilling to provide information to a receiver 62 located above the earth's surface 70, to permit a drill operator to be apprised of the direction and inclination of the drill bit 72 at the lower most extremity of the well 64 as drilling occurs. The signal repeater 30 of the present invention that receives signal 44 from DSU 50, and which stores and after a delay resends signal 44 in the manner hereinafter described above insulating gap 1 in a drill pipe 2, is shown in detail in FIG. 1. With reference to FIG. 1 and signal repeater 30 shown therein, such signal repeater 30 comprises inter alia a power source 3, the negative terminal of which power source 3 is electrically connected to the drill-pipe segment 2 on the downhole side of insulating gap 1. Electrically connected at contact 31 to the drill-pipe segment on the downhole side of insulating gap 1 is Switch 5 through input sensing line 18. The high power switch 4 (controlled by switch driver 16) electrically connects the positive terminal of the power source 3 via output line 20 to the drill-pipe segment on the uphole side of insulating gap 1. At all times Controller 17 uses input sensing line 22 to monitor the state of electrical activity at contact 21 enabling Controller 17 to perform synchronization and error checking functions. During the receiving cycle of operation Controller 17 uses bus line 7, Switch 5, and input sensing line 18 to detect the charge disturbances resulting from the electrical activity of the DSU (then sending), a record of which disturbances (or lack thereof) is entered into the registers of Memory 13 (after filtering and demodulation by Demodulator 12, which feeds Memory 13 during the receiving cycle thereby recording the data arriving from the DSU) where the information is stored until the DSU enters a silence period synchronized with the filling of the registers of Memory 13 designed to store at least one unit of data (in the preferred embodiment in the range of 14–72 bits). Controller 17 uses bus line 19 to monitor the status of the registers of Memory 13. A person of ordinary skill in the art of down hole data transfer would realize that this design is not restricted to a BPSK protocol and that the repeater may be integral to the insulating gap component. Switch 5 is controlled by both Controller 17 and the output (enabling pulse) of Pulse Generator 11 in turn controlled by Lock Detector ("LD")10. The output from Switch 5 is input to Adaptive Amplifier 6, the output from which is regulated by information supplied via bus line 7 before feeding into Band Pass Filter ("BPF") 8 (necessary to filter the 10 Hz Carrier signal of the BPSK protocol in the preferred embodiment). BPF 8 feeds an optional Carrier Recovery Unit ("CRU") 9, needed for the BPSK implementation of the preferred embodiment, and a Demodulator 12 in parallel. CRU 9 feeds into LD 10, which generates an output impulse matching the carrier presence period, as well as into Demodulator 12. During the sending cycle of the Repeater's operation Controller 17 causes Memory 13 in cooperation with Carrier Generator ("CG") 15 to communicate with the Modulator 14 that feeds switch driver 16 to re-send the message stored in Memory 13, which resending happens during the silence period between messages from the DSU, which silence period corresponds to the duration of the Pulse Generator 11 output impulse. During the sending cycle Controller 17 disables the input terminal fed by input line 18 or otherwise prevents feedback of its own output through input sensing line 18. When LD 10 feeds into Pulse Generator 11 opening Switch 5, it enables Carrier Generator ("CG") 15 and Memory 13 in combination with Controller 17 to read or set the duration of the Repeater's transmit period. Repeater output signals are of longer duration than the DSU signals, but do not influence the reception process due to the strong low-pass filtering characteristics of geologic formations. In one of the preferred embodiments, using BPSK modulation requires that each impulse have a very stable time duration, which duration may only have one of two values, base or double base length. The same applies to the time period between the impulses. When the DSU signal is of double duration Pulse Generator 11 generates another impulse. Over short distances between the DSU 50 and a repeater, while the DSU signal still has a form close to square, the process is simplified since the beginning and end of the DSU signal may be detected by the differentiation circuit, amplified, and then used to start and stop a two-state multivibrator such as may be deployed as Pulse Generator 11.

Figure 3:
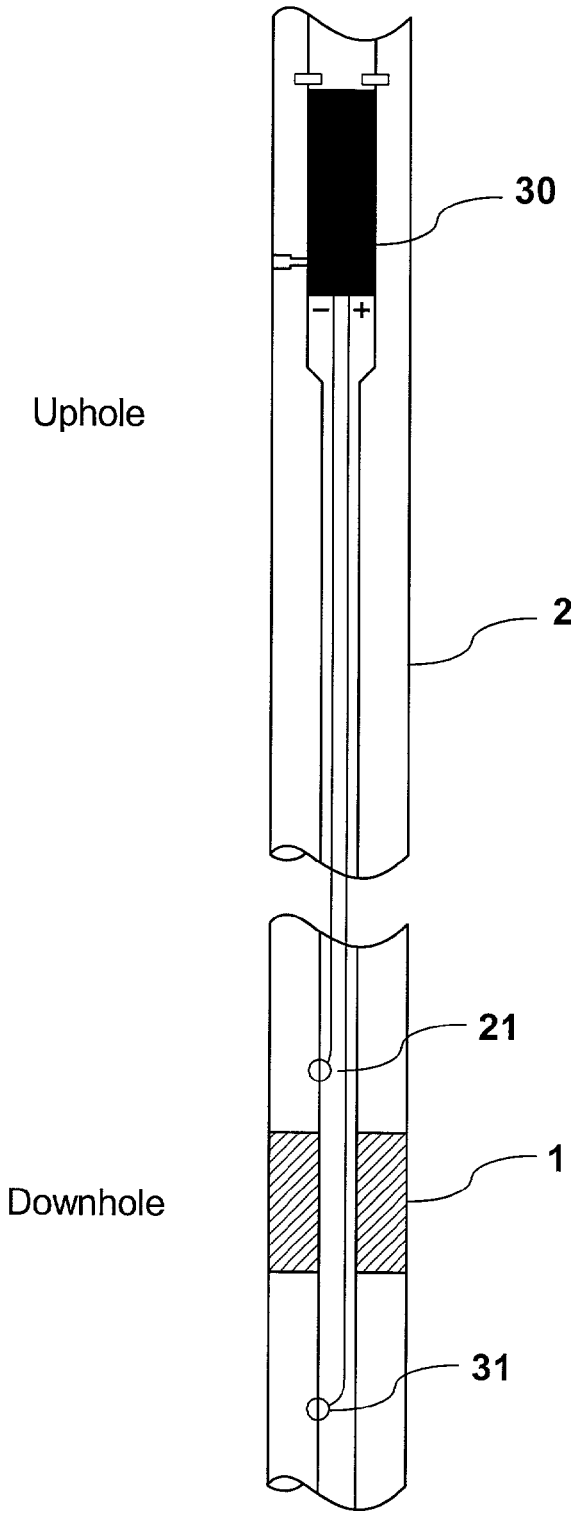
FIG. 3 is an enlarged view 'A' of the ECD signal repeater apparatus shown in FIG. 2 to permit passage of a signal across an insulating gap.

In one embodiment of the present invention as shown in FIG. 2, the invention comprises a signal repeater apparatus 30 that is part of a system that may be installed in a drill-string 2 for use in a deep well 64 for sensing signals 44 that follow the drill-string 2 rather than sensing the electromagnetic residuals that pass through the surrounding geologic formation. The signal repeater 30 of the present invention in one of its embodiments is shown in further detail in FIG. 3, installed within a drill-string 2. In FIG. 3 the ECD signal repeater's points of electrical contact 31 (downhole) and 21 (uphole) are illustrated in proximity to an insulating gap 1.

In one of its broadest embodiments, the invention comprises an apparatus that implements Binary Phase Shift Keying ("BPSK"), which has become an industry standard that, once a valid signalling sequence has been initiated, is based on only two states, being single or double time pulse (or silence) length. BPSK is a low-level protocol used in communication where the information is carried by the presence or absence of a 180 degree inversion of the "carrier" waveform. Under the BPSK scheme the bits/second and baud (symbols/second) match. The protocol is often used where a very robust (not prone to error) system of line-coding is required. Baud is the unit in which the information carrying capacity or "signaling rate" of a communication channel is measured. One baud is one symbol (state-transition or level-transition) per second. This coincides with bits per second only for two-level modulation with no framing or stop bits. The invented method permits the apparatus to function with Silence Time alone independent of memory but at a very low data transfer rate that ensures the medium has fully relaxed and sending one pulse at a time all the way from the well bottom to the surface.

In the preferred embodiment, the signal repeater 30 of the present invention utilizes BPSK with both Silence Time and Memory. The preferred transmission sequence is based six second units of data and ten seconds of interstitial silence time, but a person of ordinary skill in the art could adjust this combination to develop a variety of effective transmission sequences for different electro-physical conditions in the formation. The Control Circuitry component 17 includes firmware that deals with: an initiation sequence, counts beats according to the particular protocol or encoding scheme (BPSK in some embodiments) in use, detects when the register is full (one data unit), imposes a quiescent period to allow the medium and the drill-pipe to stabilize electrically, transfers the data unit stored in the register uphole via the output line, then resets the entire circuit in preparation to receive the next data unit from the adjacent downhole ECD component (whether a DSU 50 or a previous repeater unit 30).

In the preferred embodiment, for D&I data transfer, the repeaters 30 are not individually encoded to identify themselves to one another, but a person skilled in the art would see the alternative to implement repeaters that can also communicate individual identifiers.

An alternate embodiment of the system 40 of the present invention shown in FIG. 2 is based on a plurality of repeaters 30, the number required depending on the depth of the well and the conductivity of the geologic formation. Ordinary sections of drill-pipe 2 strung together are used to guide disturbances between repeaters 30 that sense changes in the static electrical potential on the surface of the drill-pipe 2. Simple but very high-gain detectors may be incorporated into the signal repeater 30 to read fluctuations in the local electrical potential on the surface of an associated section of drill-pipe 2. Using a signal delineation scheme based on a pre-set but adjustable Silence Time the presence or absence of triggering disturbances (in the baseline electrical potential) results in a BPSK protocol signal of a predetermined number of bits that is either stored (as in the preferred embodiment) for later sending or directly transferred at relatively long intervals. At the time of their transfer the bits of a signal 44 are guided uphole along the next higher drill-pipe segments 2 to become the triggering disturbances for the next device detecting those bits. The final uphole receiving device at point 30*a* may use any appropriate technology to transfer the signal to the surface equipment 62. For example, once the bits comprising the subject signal reach a point sufficiently near the surface, a traditional uphole transmitter may be used to "radiate" the information into the formation for detection by well-known EFT techniques such as those taught in U.S. Pat. Nos. 6,188,223, and 5,883,516

Although the disclosure describes and illustrates preferred embodiments of the invention, it is to be understood that the invention is not limited to these particular embodiments. Many variations and modifications will now occur to those skilled in the art of down hole data transfer. For full definition of the scope of the invention, reference is to be made to the appended claims.

We claim:

1. A signal repeater adapted for use with a pipe string within a well, said pipe string having therealong at least one insulating gap comprising a substantially non-electrically conductive portion, said signal repeater mountable within said pipe string, comprising:

a source of electrical energy;

means for electrically contacting said pipe string on a downhole side of said insulating gap, for receiving a pre-modulated electrical signal from said pipe string;

means for storing said signal in a memory means;

means for initiating the re-sending of said signal; and means for impressing said signal on said pipe-string on an uphole side of said insulating gap.

2. The signal repeater as claimed in claim 1, said means for electrically contacting said pipe string comprising an electrical point of contact along said pipe string on a downhole side of said insulating gap;

said means for impressing said signal onto said pipe string comprising an electrical point of contact with said pipe string on an uphole side of said insulating gap, and;

means for applying said signal across said point of contact on said downhole side and said point of contact with said pipe string on said uphole side of said insulating gap.

3. A system for communicating information between downhole equipment in a well bore and equipment nearer to the earth's surface, comprising:

a pipe string extending downhole into the well bore, having therealong at least one insulating gap comprising a substantially non-electrically conductive portion preventing transmission of current from said pipe string downhole of said gap to said pipe string uphole of said gap;

a downhole device electrically coupled to said pipe string for impressing a pre-modulated electrical signal onto said pipe string; and a signal repeater means mounted within said pipe string proximate said insulating gap, said signal means comprising:

a source of electrical energy;

means for electrically contacting said pipe string on a downhole side of said insulating gap, for receiving a pre-modulated electrical signal from said pipe string;

means for storing said pre-modulated signal in a memory means so as to produce a stored signal; and means for transmitting said stored signal uphole by impressing it on a surface said pipe-string on an uphole side of said insulating gap.

4. The system as claimed in claim 3, said means for electrically contacting said pipe string comprising an electrical point of contact along said pipe string on the downhole side of said insulating gap; and said means for impressing said stored signal on said pipe string comprising an electrical point of contact with said pipe string on the uphole side of said pipe string.

5. A method for communicating information between downhole equipment in a well bore and equipment nearer the earth's surface via a pipe string utilizing a signal repeater means mounted within said pipe string, said pipe string having an insulating gap comprising a substantially non-electrically conductive portion, comprising:

receiving information in the form of a pre-modulated electrical signal from a point of electrical contact of said signal repeater means with said pipe string at a position intermediate said downhole equipment in the well bore and said equipment nearer the earth's surface and proximate said insulating gap in said pipe string;

storing said signal locally in memory means within said repeater means;

initiating the re-sending of said signal; and impressing said signal onto a surface of said pipe string to enable said signal to pass further along said pipe string.

6. The method as claimed in claim 5 for use with a pipe string having therealong at least one electrically insulating gap comprising a substantially electrically non-conductive portion;

situating said signal repeater means proximate said insulating gap;

said step of receiving information from a point of electrical contact with said pipe string comprising electrically contacting said pipe string proximate said electrically non-conductive portion but on the downhole side thereof so as to receive signals from said point of contact with said pipe string; and said step of impressing said signal onto said surface of said pipe comprising applying said signal across said point of electrical contact with said pipe string downhole from said insulating gap and a point of electrical contact with said pipe string uphole from said insulating gap.

7. The method as claimed in claim 5, further comprising the step, after storing the signal in memory means, of introducing a time delay prior to initiating the resending of the signal, of significant delay to allow dissipation of the received pre-modulated signal in a formation in which the well is drilled, prior to initiating the step of initiating the resending of the stored signal.

* * * * *